US007828458B2

(12) United States Patent
Crow

(10) Patent No.: US 7,828,458 B2
(45) Date of Patent: Nov. 9, 2010

(54) PORTABLE LIGHT SOURCE SHADE

(75) Inventor: Richard Crow, Manhattan Beach, CA (US)

(73) Assignee: Gloshade Industries, Inc., Manhattan Beach, CA (US)

( * ) Notice: Subject to any disclaimer, the term of this patent is extended or adjusted under 35 U.S.C. 154(b) by 160 days.

(21) Appl. No.: 12/163,884

(22) Filed: Jun. 27, 2008

(65) Prior Publication Data

US 2009/0059575 A1 Mar. 5, 2009

Related U.S. Application Data

(60) Provisional application No. 60/968,844, filed on Aug. 29, 2007.

(51) Int. Cl.
*F21L 26/00* (2006.01)

(52) U.S. Cl. ..... 362/191; 362/255

(58) Field of Classification Search ..... 362/172, 362/173, 191, 255, 256, 266, 296.01
See application file for complete search history.

(56) References Cited

U.S. PATENT DOCUMENTS 3,884,460 A * 5/1975 Jiruse ..... 271/98
5,733,030 A * 3/1998 Cohn et al. ..... 362/34

* cited by examiner

*Primary Examiner*—David V Bruce
(74) *Attorney, Agent, or Firm*—Mintz, Levin, Cohn, Ferris and Glovsky and Popeo, P.C.

(57) ABSTRACT

A low cost, lightweight device that can be coupled with a portable light source such as a chemiluminescent light stick to create a small, focused and directional source of light. The device can be readily dismantled into a portable flat configuration and then reassembled with minimal effort as needed.

19 Claims, 9 Drawing Sheets

PORTABLE LIGHT SOURCE SHADE

CROSS-REFERENCE TO RELATED APPLICATION

This application claims the benefit of U.S. provisional patent application Ser. No. 60/968,844, filed on Aug. 29, 2007 and entitled "Portable Light Source Shade," which is incorporated by reference herein in its entirety.

FIELD

The subject matter disclosed herein relates to shade devices for use with portable light sources.

BACKGROUND

Military units, such as for example special forces or other troops who are active at night, can use small, lightweight, inexpensive portable light sources such as chemiluminescent light sticks as light sources to provide lighting needs. These light sources can also be used in other applications, such as for example by hunters, law enforcement personnel, campers, and the like; as well as in any other situation requiring inexpensive, lightweight, long-lasting light. In some situations, emission of stray light from such devices could present a danger, for example by betraying a military unit's position to enemy forces, or an inconvenience, for example by ruining a hunter's night vision in directions away from the light source. Additionally, these portable light sources tend to be omnidirectional while tasks that require lighting might be better served with a more directed beam from the light source.

SUMMARY

In a first aspect, an apparatus includes a flexible device that has a first side, a second side shaped substantially similarly to the first side, an outer edge, a first joining edge, and a second joining edge. The flexible device is approximately flat with the first and the second sides disposed opposite one another such that the outer edge joins the first side and the second side along a substantial portion of a perimeter of the first side and the second side. The first joining edge and the second joining edge define a gap such that the outer edge does not continue uninterrupted around the entire perimeter of the flexible device. The flexible device flexes to form an assembled structure in which the first joining edge is disposed proximate to the second joining edge. The assembled structure encloses an inner volume with a first opening that is defined by the outer edge and an apex disposed opposite the first opening. The apex has a smaller cross sectional area than the first opening. The first side forms an inner surface of the assembled structure and the second side forms an outer surface of the assembled structure. The apparatus also includes joining means for connecting the first joining edge and the second joining edge and attaching means for securing a portable light source to the assembled structure to direct light from the portable light source in a desired manner. The portable light source has an elongated shape along a first axis and emits light both in the directions of the first axis and perpendicular to the first axis.

In an interrelated aspect, a method includes curving a flexible device such as those described herein into an assembled structure, securably connecting the first joining edge and the second joining edge of the flexible device; and attaching a portable light source to the assembled structure to direct light from the portable light source in a desired manner. The portable light source can have an elongated shape along a first axis and emit light both in the directions of the first axis and perpendicular to the first axis.

In optional variations, one or more of the following additional features can be included. The first side can include a reflective surface. The second side can include a dark colored and opaque surface. The attaching means can include a strap that wraps around the portable light source around the axis of the portable light source, thereby securing the portable light source to the assembled device. The flexible device can include a notch disposed approximately near a center of the flexible device. The notch can form a second opening that is opposite and smaller than the first opening when the flexible device forms the assembled structure.

The attaching means can include a strap disposed near the notch. The strap can wrap around the portable light source around the axis of the portable light source thereby securing the portable light source to the assembled structure with at least part of the portable light source extending out of the second hole to outside of the assembled structure. A remainder of the portable light source length along the axis can extend into the inner volume of the assembled device toward or out through the first opening. Alternatively, the portable light source can be secured to the assembled structure with at least part of the portable light source extending into the second hole to the inner volume of the assembled structure such that a remainder of the portable light source length along the axis extends outside the assembled device in a direction opposite the first opening so that the portable light source is supported by the assembled structure to form a free standing lantern device. The second side of the flexible device can include a reflective material and be oriented facing outward away from the inner volume in the assembled structure to reflect light from the portable light source outward and upward in the free standing lantern device.

The attaching means can include a light source affixing device that includes a socket side with a socket that accepts an end of the portable light source and an attachment side that can further include a tapered portion and a head with a larger cross section than the tapered portion. The head can be disposed at an opposite end of the tapered portion from the socket side. The socket can include a flexible or semi-flexible material that resiliently expands at least slightly to accept the end of the portable light source. The apex of the assembled structure can include a gap or opening that is large enough to accept the tapered portion but not to allow the head or the socket section to pass. The light source affixing device can be oriented in the assembled structure such that the socket section is disposed outside of the assembled structure so that the socket faces away from the first opening such that the portable light source affixed in the socket is supported by the assembled structure to form a free standing lantern device. The second side of the flexible device can include a reflective material and be oriented facing outward in the assembled structure to reflect light from the portable light source outward and upward in the free standing lantern device.

The apparatus can further include the portable light source, which can be a chemiluminescent light stick. The outer edge can define a substantial portion of a circle and the first joining edge and the second joining edges can each be perpendicular to the outer edge and each define a substantial portion of a diameter of the circle such that the first and the second sides are each circular with a fraction of the circle missing as defined by a gap between the first joining edge and the second joining edge. The assembled structure can include an approximately 45 degree cone-shaped shade with an approximately ⅝" diameter second opening at the apex. An adjustable carrying strap can also be include at the apex.

The current subject matter can provide, among other potential benefits and advantages, a portable, adaptable device for shading and/or directing light from a portable light source. The subject matter can also provide a portable base for a light source. Among other potential benefits of the subject matter described herein, a rugged, lightweight, and versatile shade can be provided that directs light from a portable light source, such as for example a chemiluminescent light stick in a desired direction while minimizing light emission in other directions. This capability can be very useful in applications in which light is needed to perform various tasks but in which emission of the light outside of a controlled area can be undesirable. For example. The current subject matter provides a lightweight, inexpensive device that can be used in one example to direct the majority of the lighting power from a portable light source in one direction and to prevent light from escaping in other directions.

The details of one or more variations of the subject matter described herein are set forth in the accompanying drawings and the description below. Other features and advantages of the subject matter described herein will be apparent from the description and drawings, and from the claims.

DESCRIPTION OF DRAWINGS

The accompanying drawings, which are incorporated in and constitute a part of this specification, show certain aspects of the subject matter disclosed herein and, together with the description, help explain some of the principles associated with the disclosed embodiments. In the drawings.

DETAILED DESCRIPTION

The current subject matter can be implemented in a variety of configurations that each provide one or more of the aforementioned beneficial features. The following descriptions are addressed to an example implementation that include a device that is shaped approximately like a substantial portion of a flexible, circular disk having a central hole and means for connecting two joining edges of the disk to form a cone with a first opening near its apex and a larger second opening opposite the apex. A portable light source, perhaps having an elongated shape, can be secured within the first hole or otherwise near the apex of the cone such that the body of the light source is directed toward and possibly beyond the extent of the larger second opening. In this manner, the material forming the cone can prevent light from the light source from being projected outside of the device in the general direction of the apex of the cone. The interior surface of the assembled device can include a reflective coating that increases the intensity of light being projected out of the second opening of the device and in a general direction away from the apex. It will be readily understood that other geometrical shapes besides a circular disk and a cone are within the scope of the currently disclosed subject matter.

Figure 1:
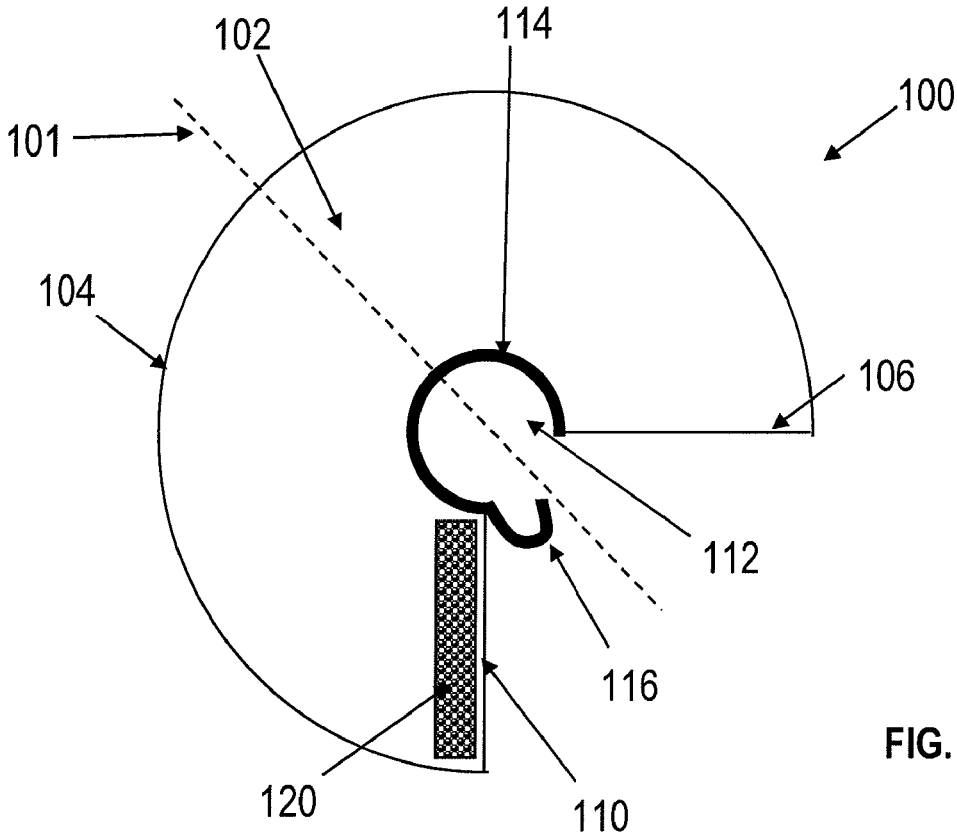
FIG. 1 is a schematic diagram showing a first side of a light shade device in a disassembled state.
Figure 2:
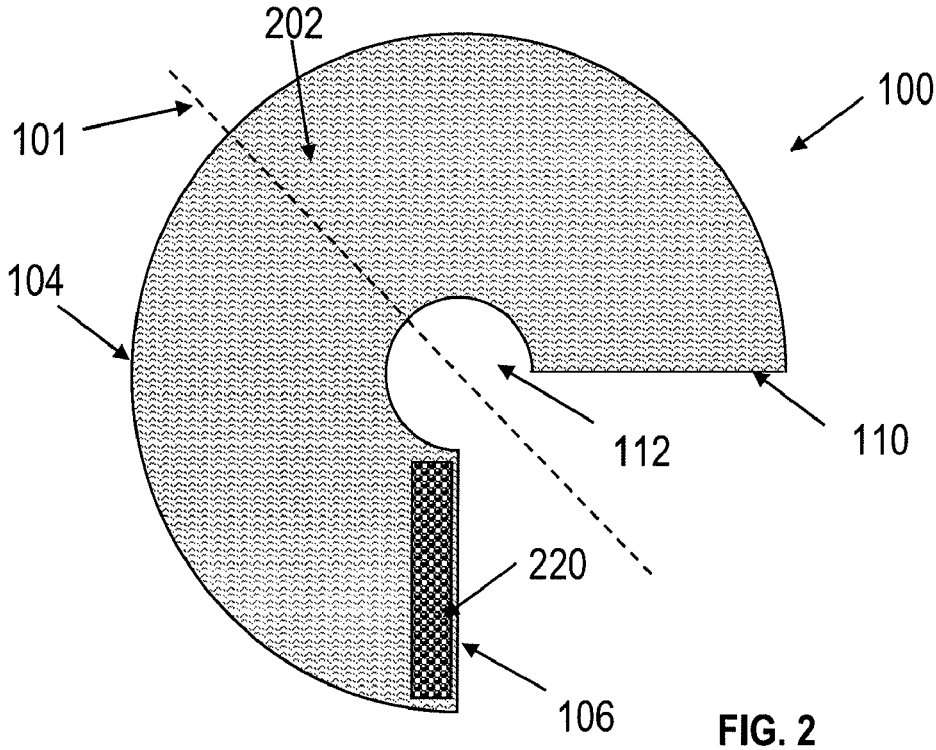
FIG. 2 is a schematic diagram showing a second side of a light shade device in a disassembled state.

FIG. 1 and FIG. 2 are diagrams of opposite sides of a such a flexible device 100. The first side 102 of the flexible device 100 is shown in FIG. 1 and the second side 202 is shown in FIG. 2. The view of the flexible device 100 in FIG. 2 represents the results of a rotation of the flexible device 100 about the axis 101. The first side 102 includes a circular shaped piece of semi-rigid or flexible material such as for example plastic, cardstock, or the like. The flexible device 100 can in some examples be opaque or approximately opaque and can further be optionally covered on the first side by a material that is durable to environmental conditions, such as for example nylon cloth, canvas, or the like. The first side 102 of the flexible device 100 can optionally be colored black or some other dark color to cut down on visibility and/or pass-through of light when the flexible device 100 is assembled and mated with a portable light source as further described below. The flexible device 100 further includes an outer edge 104 that extends, in the example shown, for some fraction (in the example shown, about 75%) of the arc of a complete circle. In the example shown, in which the flexible device 100 is approximately circular, the outer edge 104 is curved and smooth. Neither the curvedness nor the smoothness of the outer edge 104 are necessary features in all possible implementations. The outer edge 104 is disposed between a first joining edge 106 and a second joining edge 110.

A notch 112 can also be provided approximately in the center of the flexible device 100. In the example shown, the notch 112 is curved in the shape of an arc describing about 75% of a circle. Other shapes of the notch 112 are possible as well. In some implementations, the notch 112 and the outer edge can define approximately congruent shapes to give the device 100 some degree of rotational and/or axial or planar symmetry when it is fully assembled. The notch 112 can also optionally be shaped to be compatible with the shape of a portable light source. A curved, circular notch 112 as shown in FIG. 1 and FIG. 2 can be used for a cylindrical light source. Other shapes of the notch 112 can be used for, for example rectangular or triangular cross sections of the portable light source. The notch 112 can also be encircled by a collar 114 that can have a securing flap 116. The collar 114 and the securing strap 116 can include a fastener or attaching segment such as for example a hook and loop connector like Velcro™ that allow the collar to be wrapped and secured with some snugness around a portable light source that is inserted into the notch 112.

The flexible device 100 can also include a connection means, such as for example a fastener device or devices or other means of affixing the first joining edge 106 and the second joining edge 110. In one example, as shown in FIG. 1 and FIG. 2, a first strip 120 of a hook and loop fastener system is attached near the second joining edge 110 on the first side and a second strip 220 of a hook and loop fastener system is attached near the first joining edge 106 on the second side 202. The fastener system can be a hook and loop system as described, or can alternatively be one or more adhesive strips that can be either removable and reusable (such as the adhesive found on Post-It™ notes available from 3M of Minneapolis) or permanent. A piece of adhesive tape can alternatively be provided, and this can be a double-sided adhesive adhered to one side of either the first joining edge 106 or the second joining edge 110. Alternatively, the tape can extend from one of the first joining edge 106 or the second joining edge 110 such that it can extend onto the same side of the device 100 over the opposite joining edge when the joining edges are brought together. The fastening system can also be of a mechanical design, such as for example a tab and slit or hook and slit design. The second side 202 of the device 100 can include silvering or some other reflective surface or surface treatment that can reflect light from the portable light source.

Figure 3:
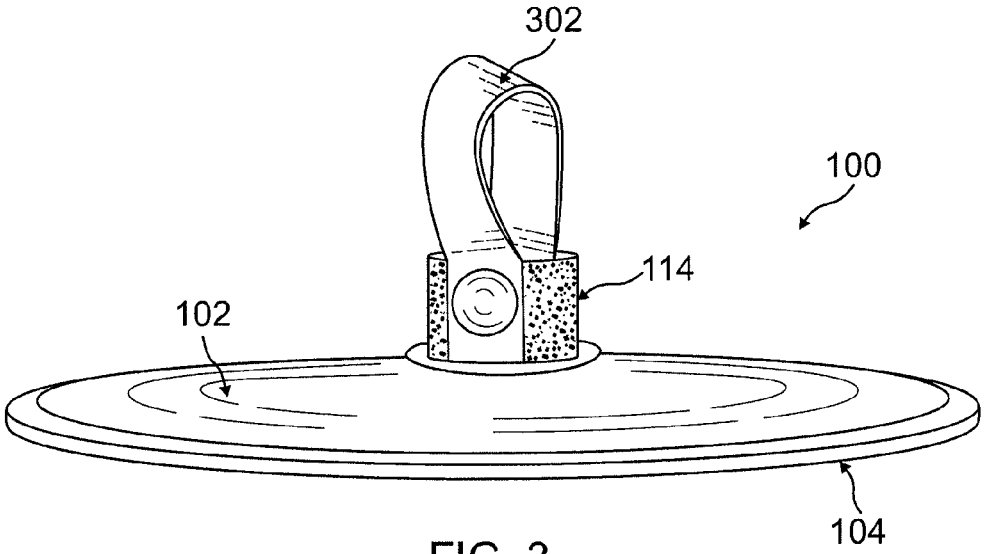
FIG. 3 is a schematic diagram showing a first isometric view of a light shade device in an unassembled state.
Figure 4:
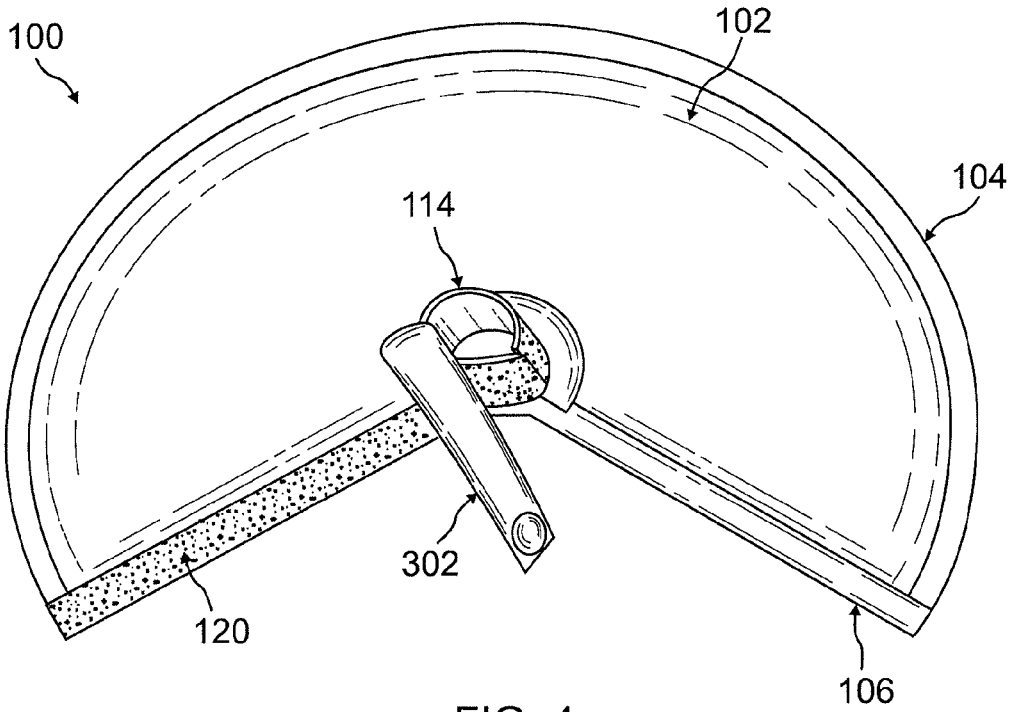
FIG. 4 is a schematic diagram showing a second isometric view of a light shade device in an unassembled state.

Additional perspective views of a flexible device 100 that is consistent with the current subject matter are shown in the isometric diagrams of FIG. 3 and FIG. 4. FIG. 3 and FIG. 4, which provide two additional views of the first side of the device 100, show the collar 114 and securing flap 116 as well as an additional attachment loop 302 that extends above the collar 114 and can be used, for example to hang the device from an elevated support or to secure the device to clothing, equipment, etc. Other shapes and sizes of such an attachment loop 302 can be used with the current subject matter depending on the desired application of the flexible device 100.

FIG. 1 through FIG. 4 show the flexible device 100 in a configuration appropriate for storage, sale, or transport. FIG. 5 through FIG. 8 show the flexible device in an assembled configuration 500 in which it is ready for or actually in use. In these figures, the flexible device has been wrapped around itself to form a cone-shaped shade 500 with the first side 102 facing outward and the second side 202 facing inward. The second joining edge 106 overlaps the first joining edge such that the first strip 120 and the second strip 220 (not shown in FIG. 5) of the fastener system mate and secure to one another. The outer edge 104 of the flexible device 100 forms a first, larger opening 502 at the base of the assembled device 500, which in this example resembles a cone. The collar 114 and the securing strap (116 but not shown in FIG. 5) are wrapped around a second opening 504 formed by the notch (112 but not shown in FIG. 5). In one example, when the first joining edge 104 and the second joining edge are affixed, a 45 degree cone-shaped shade 500 with an approximately ⅝" diameter second opening 504 at the top is formed. Other sizes and shapes of the second opening 504 and the assembled device 500 can be used depending on the specific application.

Figure 5:
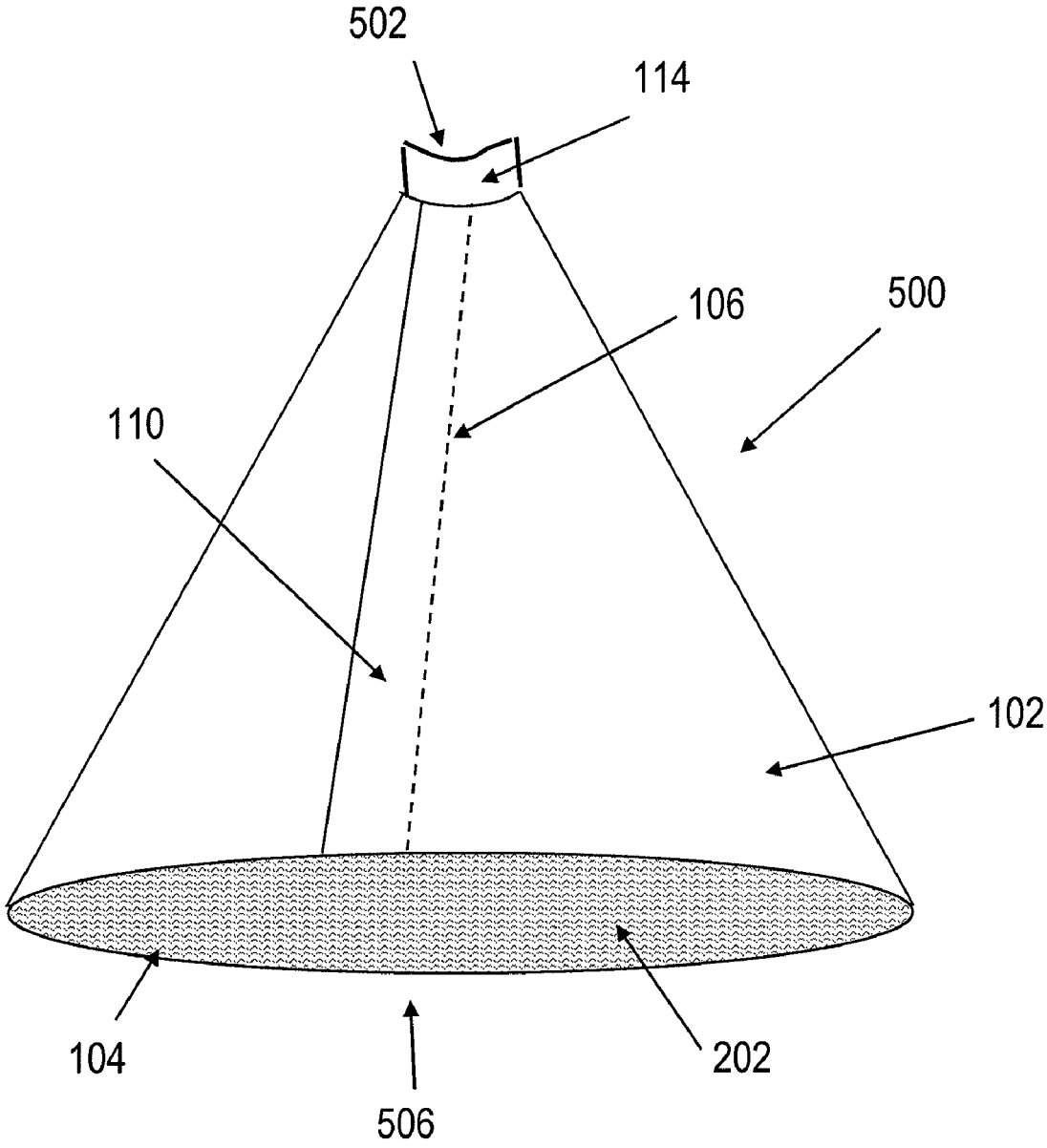
FIG. 5 is a schematic diagram showing a first isometric view of a light shade device in an assembled state.
Figure 6:
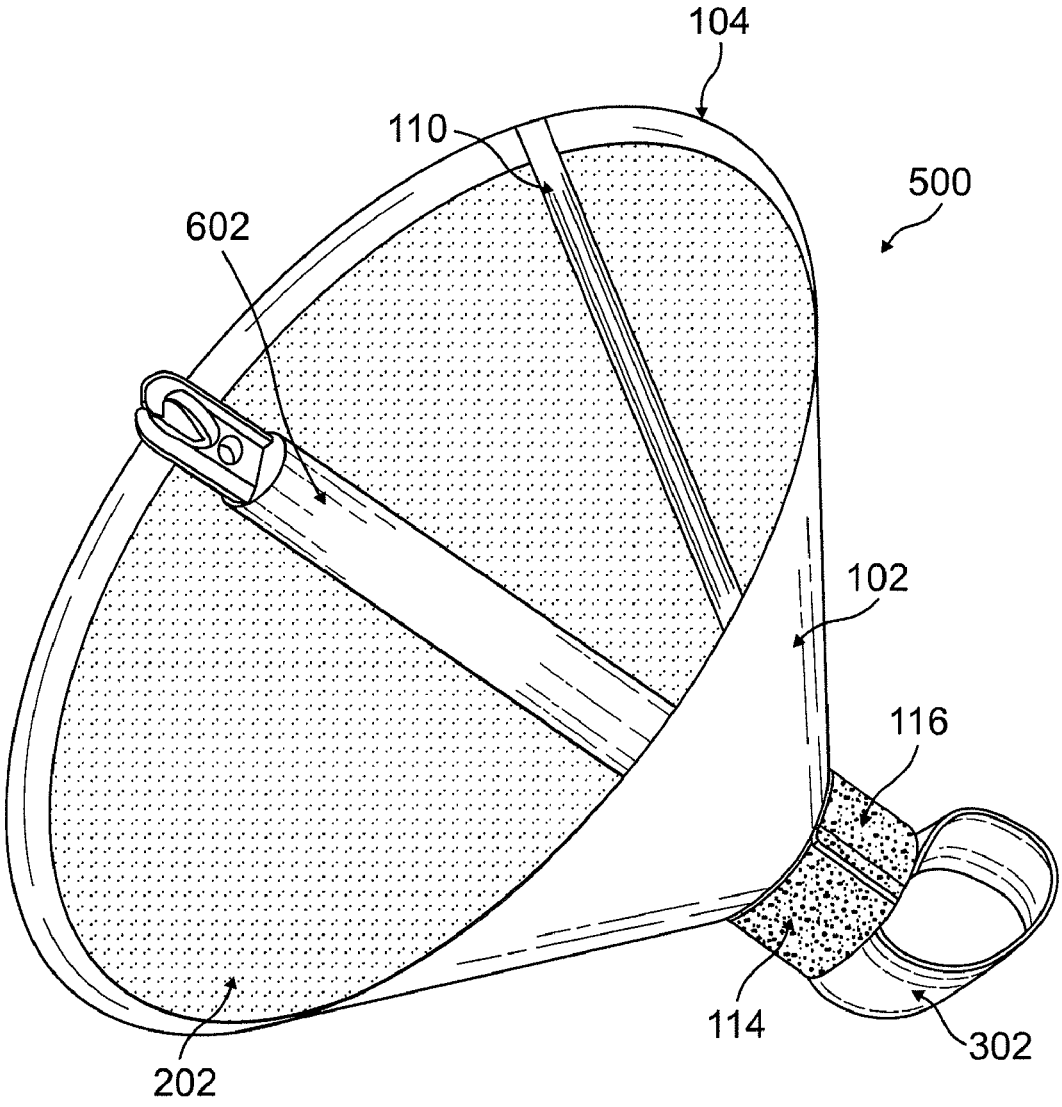
FIG. 6 is a schematic diagram showing a first isometric view of an assembled light shade coupled to a portable light source.
Figure 7:
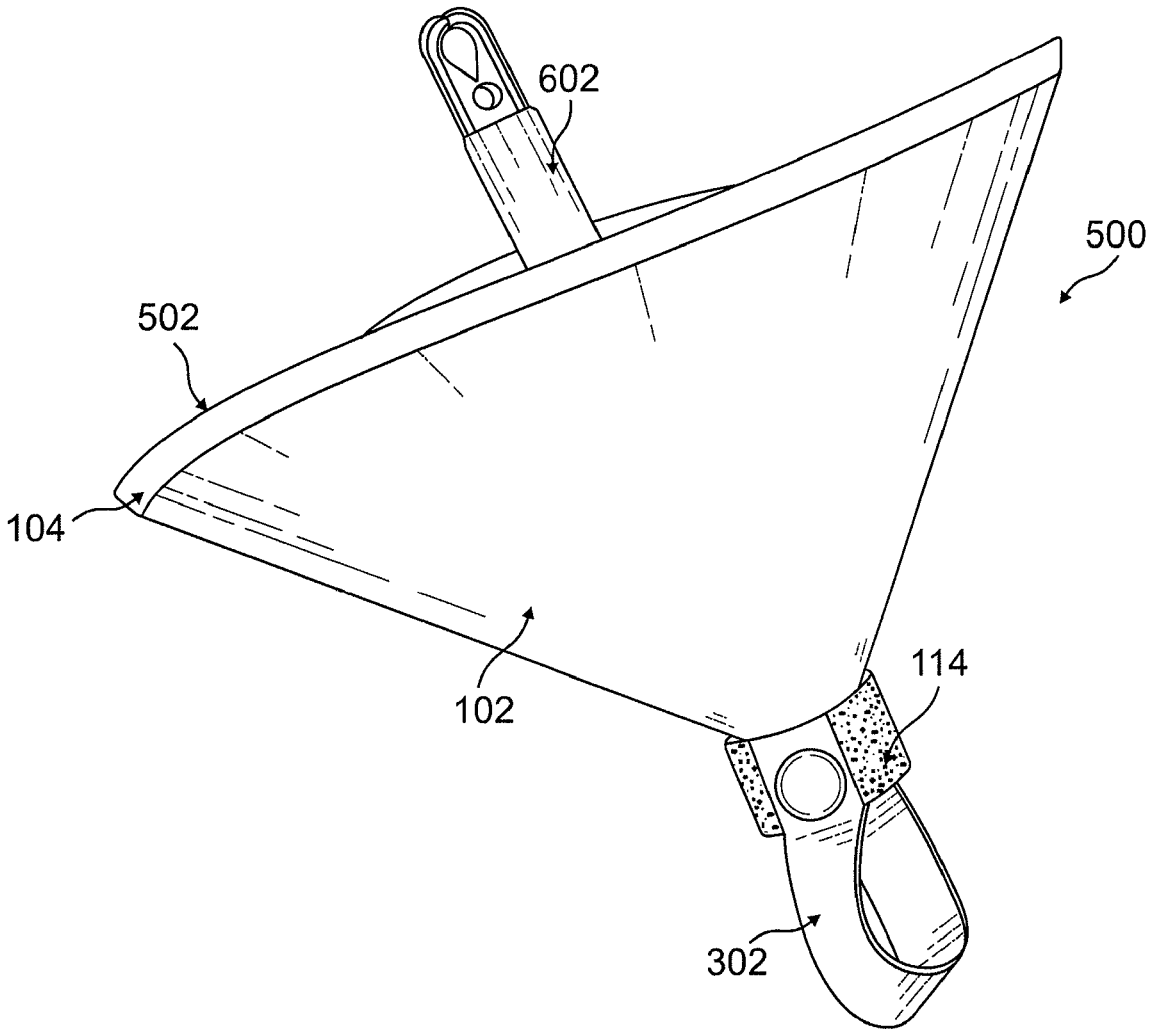
FIG. 7 is a schematic diagram showing a second isometric view of an assembled light shade coupled to a portable light source.
Figure 8:
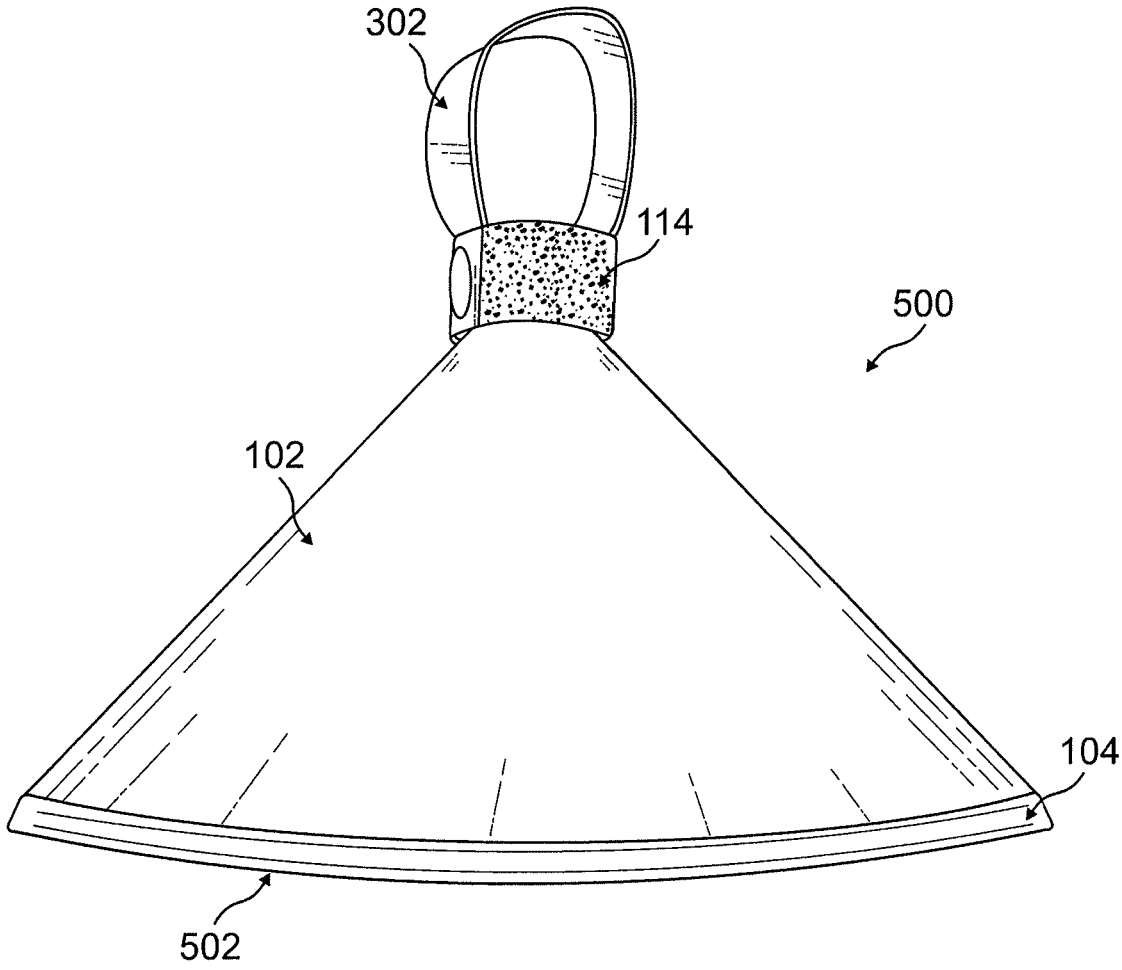
FIG. 8 is a schematic diagram showing an isometric view of a light shade device in an assembled state.

The second opening 504 can accept a portable light source 602, such as for example a chemiluminescent stick or similar sized light source as shown in FIG. 6. The portable light source 602 can optionally be secured in place by the collar 114 and the securing flap 116. As noted above, the surface of the second side 202 of the flexible device 100 can include a silvered or other reflective material as shown in FIG. 5 and FIG. 6, thereby allowing the assembled device 500 to reflect light emitted from the portable light source and focus it out the first, larger opening 502 at the base to create a narrower, more concentrated and directional light source than the portable light source 602 would create absent the assembled device 500. Because the material that makes up the flexible device 100 can be completely opaque, when the assembled device 500 is held facing outward (in other words, facing the exterior of the assembled device 500), the material of the device can completely or nearly completely shield a user's eyes from the portable light source 602, thereby greatly increasing the usefulness of the projected light.

Figure 9:
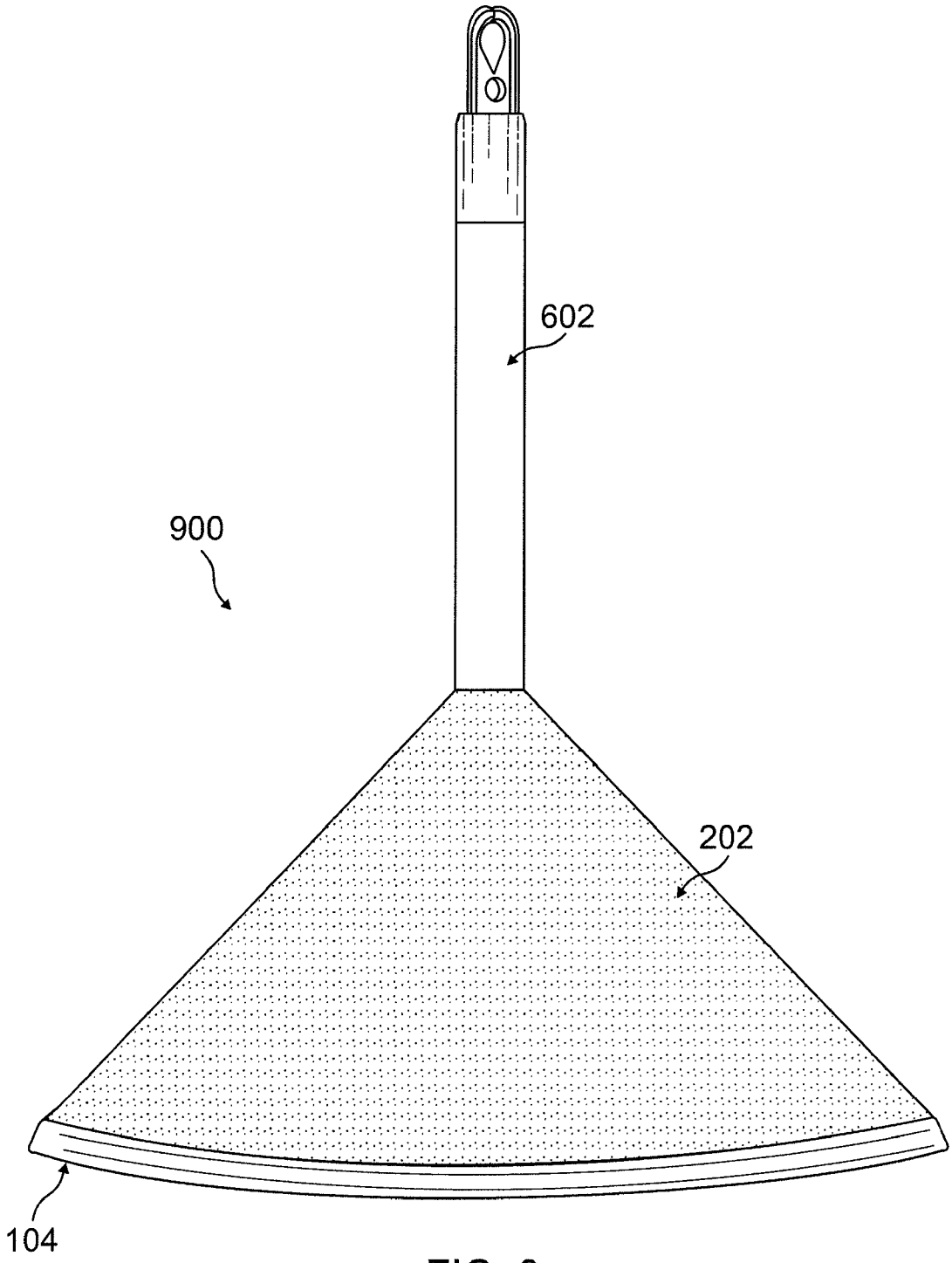
FIG. 9 is a schematic diagram showing an isometric view of a light shade device in an assembled state with a portable light source installed to form a self-supporting lantern configuration.

The flexible device 100 can also in some implementations be constructed so as to be capable of being assembled in a reversible configuration as shown in FIG. 9. In this example, the reversed assembled device 900 can stand inverted and unassisted and thereby support a portable light source 602 in a vertical or approximately vertical orientation. If the flexible device 100 includes a reflective surface 202 as discussed above, this surface can be oriented facing outward to reflect light from the portable light source 602 in an outward and/or upward direction, thereby forming a portable, lightweight, and inexpensive lantern 900 that could be used on a table or other surface.

Figure 10:
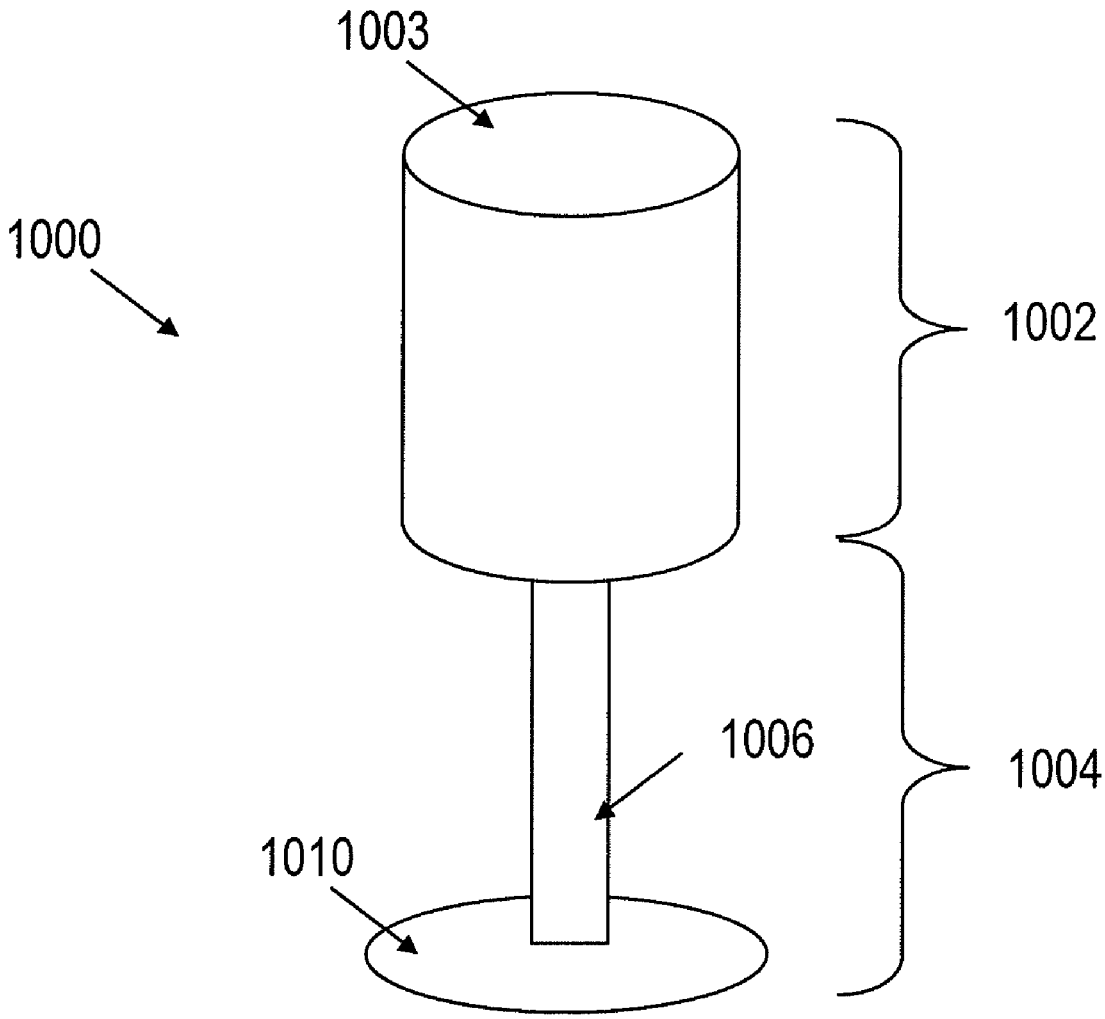
FIG. 10 is a schematic diagram showing an example of an alternative portable light source affixing device.

The current subject matter also includes portable light source shade designs that include neither a notch 112 in the unassembled device nor a second hole 504 near the apex of the assembled device 500. In such implementations, an inner collar or other comparable means for affixing a portable light source 602 can be included on the second side 202 of the flexible device 100. An example of such a device is shown in FIG. 10. A portable light source affixing device 1000 can be included with the flexible device 100 described above. Such a portable light source affixing device 1000 can include a socket side 1002 and an attachment side 1004. The socket side 1002 of the portable light source affixing device 1000 can include a socket 1003 made of a flexible or semi-flexible material that can resiliently expand at least slightly to accept the end of a portable light source 602. The attachment side 1004 of the portable light source affixing device 1000 can include a tapered portion 1006 with an at least slightly larger head 1010. When a flexible device 100 that does not include a notch 112 is formed into the assembled device 500, the tapered portion 1006 can be fitted at the apex of the assembled device such that the larger head extends above the apex of the assembled device to the outside of the cone or other shape formed by the assembled device. When the first and second connecting edges 106, 110 are connected as described above, this configuration can effectively trap the portable light source affixing device 1000 with the socket side 1002 and socket 1003 directed toward the first, larger opening 502 of the assembled device 500. A portable light source 602 can then be fitted into the socket 1003 such that the assembled device functions as described above. The portable light source affixing device 1000 can alternatively be reversed in the assembled device 500 such that the socket side 1002 is on the outside of the assembled device 500 to create a lantern device similar to that shown in FIG. 9. As in FIG. 9, in this configuration, the flexible device 100 can be reversed in forming the lantern 900 such that the reflective second side 202 faces outward.

Figure 11:
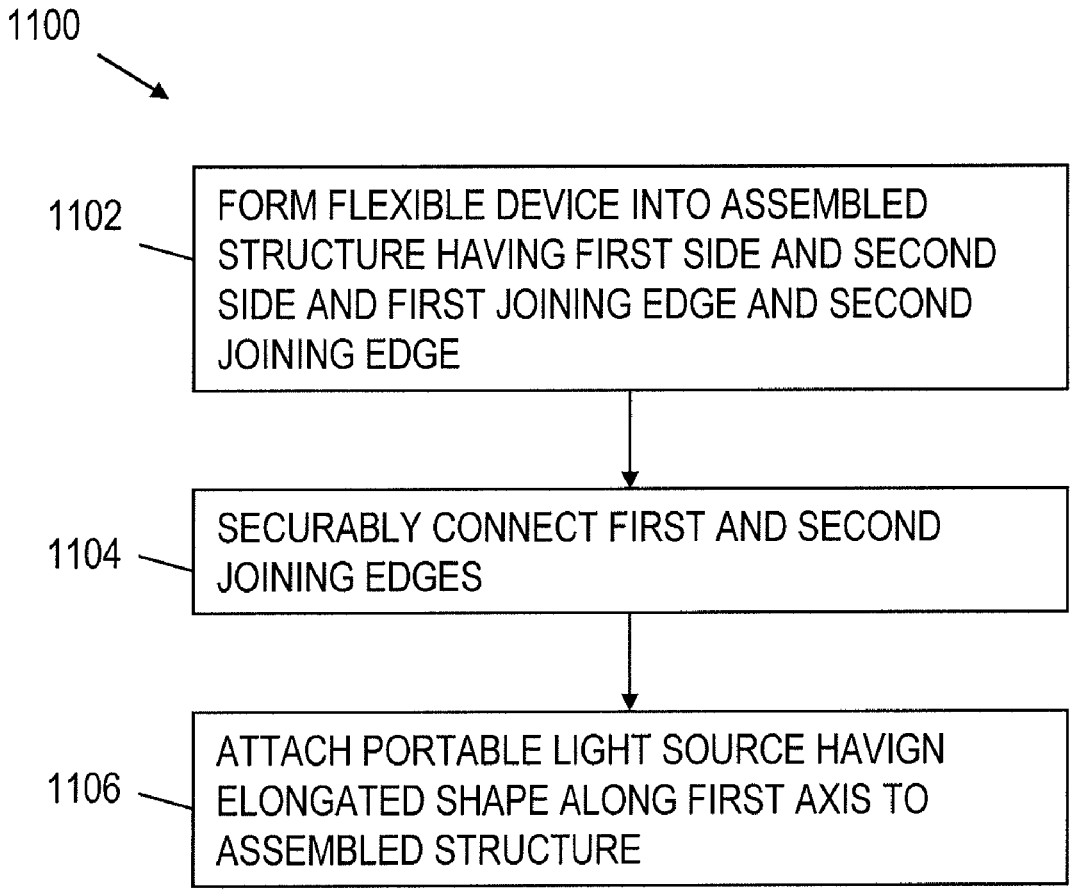
FIG. 11 is a process flow diagram describing a method according to the current subject matter.

FIG. 11 shows a process flow diagram 1100 that illustrates an exemplary method consistent with the currently disclosed subject matter. At 1102, a flexible device is formed into an assembled shade device structure, such as is described above. At 1104, the first joining edge and the second joining edge of the flexible device are securably connected using an attaching means. At 1106, a portable light source is attached to the assembled structure to direct light from the portable light source in a desired manner, the portable light source having an elongated shape along a first axis and emitting light both in the directions of the first axis and perpendicular to the first axis.

Although a few variations have been described in detail above, other modifications are possible. For example, the logic flow depicted in the accompanying figures and described herein do not require the particular order shown, or sequential order, to achieve desirable results. Other embodiments may be within the scope of the following claims.

What is claimed:

1. An apparatus comprising:

a flexible device having a first side, a second side shaped substantially similarly to the first side, an outer edge, a first joining edge, and a second joining edge, the flexible device being approximately flat with the first and the second sides disposed opposite one another such that the outer edge joins the first side and the second side along a substantial portion of a perimeter of the first side and the second side, the first joining edge and the second joining edge defining a gap such that the outer edge does not continue uninterrupted around the entire perimeter of the flexible device, the flexible device flexing to form an assembled structure in which the first joining edge is disposed proximate to the second joining edge, the assembled structure comprising an inner volume having a first opening that is defined by the outer edge and an apex disposed opposite the first opening, the apex having a smaller cross sectional area than the first opening, the first side forming an inner surface of the assembled structure and the second side forming an outer surface of the assembled structure;

an adjustable carrying strap at the apex;

joining means for connecting the first joining edge and the second joining edge; and attaching means for securing a portable light source to the assembled structure to direct light from the portable light source in a desired manner, the portable light source having an elongated shape along a first axis and emitting light both in the directions of the first axis and perpendicular to the first axis.

2. An apparatus as in claim 1, wherein the first side comprises a reflective surface.

3. An apparatus as in claim 1, wherein the second side comprises a dark colored and opaque surface.

4. An apparatus as in claim 1, wherein the attaching means comprise a strap that wraps around the portable light source around the axis of the portable light source, thereby securing the portable light source to the assembled device.

5. An apparatus as in claim 1, further comprising a notch disposed approximately near a center of the flexible device, the notch forming a second opening that is opposite and smaller than the first opening when the flexible device forms the assembled structure.

6. An apparatus as in claim 5, wherein the attaching means comprises a strap disposed near the notch, the strap wrapping around the portable light source around the axis of the portable light source thereby securing the portable light source to the assembled structure with at least part of the portable light source extending out of the second hole to outside of the assembled structure, a remainder of the portable light source length along the axis extending into the inner volume of the assembled device toward or out through the first opening.

7. An apparatus as in claim 5, wherein the attaching means comprises a strap disposed near the notch, the strap wrapping around the portable light source around the axis of the portable light source thereby securing the portable light source to the assembled structure with at least part of the portable light source extending into the second hole to the inner volume of the assembled structure, a remainder of the portable light source length along the axis extending outside the assembled device in a direction opposite the first opening such that the portable light source is supported by the assembled structure to form a free standing lantern device.

8. A apparatus as in claim 7, wherein the second side of the flexible device comprises a reflective material and is oriented facing outward away from the inner volume in the assembled structure to reflect light from the portable light source outward and upward in the free standing lantern device.

9. An apparatus as in claim 1, wherein the attaching means comprise a light source affixing device that comprises a socket side with a socket that accepts an end of the portable light source and an attachment side that further comprises a tapered portion and a head with a larger cross section than the tapered portion, the head being disposed at an opposite end of the tapered portion from the socket side.

10. An apparatus as in claim 9, wherein the socket comprises a flexible or semi-flexible material that resiliently expands at least slightly to accept the end of the portable light source.

11. An apparatus as in claim 9, wherein the apex of the assembled structure comprises a gap or opening that is large enough to accept the tapered portion but not to allow the head or the socket section to pass.

12. An apparatus as in claim 1, further comprising the portable light source, wherein the portable light source is a chemiluminescent light stick.

13. An apparatus as in claim 1, wherein the outer edge defines a substantial portion of a circle and the first joining edge and the second joining edges are each perpendicular to the outer edge and each define a substantial portion of a diameter of the circle such that the first and the second sides are each circular with a fraction of the circle missing as defined by a gap between the first joining edge and the second joining edge.

14. An apparatus as in claim 13, wherein the assembled structure comprises an approximately 45 degree cone-shaped shade with an approximately ⅝" diameter second opening at the apex.

15. An apparatus comprising:

a flexible device having a first side, a second side shaped substantially similarly to the first side, an outer edge, a first joining edge, and a second joining edge, the flexible device being approximately flat with the first and the second sides disposed opposite one another such that the outer edge joins the first side and the second side along a substantial portion of a perimeter of the first side and the second side, the first joining edge and the second joining edge defining a gap such that the outer edge does not continue uninterrupted around the entire perimeter of the flexible device, the flexible device flexing to form an assembled structure in which the first joining edge is disposed proximate to the second joining edge, the assembled structure comprising an inner volume having a first opening that is defined by the outer edge and an apex disposed opposite the first opening, the apex having a smaller cross sectional area than the first opening, the first side forming an inner surface of the assembled structure and the second side forming an outer surface of the assembled structure, the apex comprising a gap or opening that is large enough to accept the tapered portion but not to allow the head or the socket section to pass;

joining means for connecting the first joining edge and the second joining edge; and attaching means for securing a portable light source to the assembled structure to direct light from the portable light source in a desired manner, the portable light source having an elongated shape along a first axis and emitting light both in the directions of the first axis and perpendicular to the first axis, the attaching means comprising a light source affixing device that comprises a socket side with a socket that accepts an end of the portable light source and an attachment side that further comprises a tapered portion and a head with a larger cross section than the tapered portion, the head being disposed at an opposite end of the tapered portion from the socket side, the light source affixing device being oriented in the assembled structure such that the socket section is disposed outside of the assembled structure so that the socket faces away from the first opening such that the portable light source affixed in the socket is supported by the assembled structure to form a free standing lantern device.

16. An apparatus as in claim 15, wherein the second side of the flexible device comprises a reflective material and is oriented facing outward in the assembled structure to reflect light from the portable light source outward and upward in the free standing lantern device.

17. A method comprising:

curving a flexible device into an assembled structure, the flexible device having a first side, a second side shaped substantially similarly to the first side, an outer edge, a first joining edge, and a second joining edge, the flexible device, while being approximately flat, having the first and the second sides disposed opposite one another such that the outer edge joins the first side and the second side along a substantial portion of a perimeter of the first side and the second side, the first joining edge and the second joining edge defining a gap such that the outer edge does not continue uninterrupted around the entire perimeter of the flexible device, the curving causing flexible device to form an assembled structure in which the first joining edge is disposed proximate to the second joining edge, the assembled structure comprising an inner volume having a first opening that is defined by the outer edge and an apex disposed opposite the first opening, the apex having a smaller cross sectional area than the first opening, the first side forming an inner surface of the assembled structure and the second side forming an outer surface of the assembled structure, the assembled structure further comprising an adjustable carrying strap at the apex;

securably connecting the first joining edge and the second joining edge; and attaching a portable light source to the assembled structure to direct light from the portable light source in a desired manner, the portable light source having an elongated shape along a first axis and emitting light both in the directions of the first axis and perpendicular to the first axis.

18. A method as in claim 17, wherein the flexible device further comprises a notch disposed approximately near a center of the flexible device, the notch forming a second opening that is opposite and smaller than the first opening when the flexible device forms the assembled structure; and wherein the second side comprises a reflective material and the portable light source is attached to the assembled structure with at least part of the portable light source extending into the second hole to an inner volume of the assembled structure such that a remainder of the portable light source extends outside the assembled device in a direction opposite the first opening so that the portable light source is supported by the assembled structure to form a free standing lantern device.

19. A method as in claim 17, wherein the flexible device further comprises a notch disposed approximately near a center of the flexible device, the notch forming a second opening that is opposite and smaller than the first opening when the flexible device forms the assembled structure; and wherein the first side comprises a reflective material and the portable light source is attached to the assembled structure with at least part of the portable light source extending outside the assembled device in a direction opposite the first opening such that a remainder of the portable light source extends into the inner volume and directed toward the first opening so that light from the portable light source is directed in the direction of the first opening.

* * * * *